US009097257B2

(12) United States Patent
Øvsthus et al.

(10) Patent No.: US 9,097,257 B2
(45) Date of Patent: Aug. 4, 2015

(54) SCREW TYPE LIQUID RING PUMP WITH INTEGRATED MACERATOR

(75) Inventors: Eimund Øvsthus, Lonevåg (NO); Aksel Øvsthus, Lonevåg (NO)

(73) Assignee: JETS INVEST AS, Hareid (NO)

( * ) Notice: Subject to any disclaimer, the term of this patent is extended or adjusted under 35 U.S.C. 154(b) by 45 days.

(21) Appl. No.: 14/125,999

(22) PCT Filed: Jun. 12, 2012

(86) PCT No.: PCT/NO2012/000045

§ 371 (c)(1),
(2), (4) Date: Jan. 15, 2014

(87) PCT Pub. No.: WO2012/173488

PCT Pub. Date: Dec. 20, 2012

(65) Prior Publication Data

US 2014/0119975 A1 May 1, 2014

(30) Foreign Application Priority Data

Jun. 17, 2011 (NO) ..... 20110876

(51) Int. Cl.
*F04D 7/04* (2006.01)
*B02C 18/06* (2006.01)
(Continued)

(52) U.S. Cl.
CPC ..... *F04D 7/045* (2013.01); *B02C 18/0092* (2013.01); *B02C 18/06* (2013.01);
(Continued)

(58) Field of Classification Search
CPC ..... F04D 7/045; B02C 18/06; B02C 19/22
USPC ..... 241/260.1; 415/121.1
See application file for complete search history.

(56) References Cited

U.S. PATENT DOCUMENTS 2,029,766 A * 2/1936 Durdin, Jr. ..... 241/46.02
2,658,453 A * 11/1953 Walters ..... 415/97
(Continued)

FOREIGN PATENT DOCUMENTS

EP 0454794 A1 11/1991
WO 9010123 A1 9/1990
WO 2004099619 A1 11/2004

OTHER PUBLICATIONS

International Search Report issued in corresponding International Patent Application No. PCT/NO2012/000045, mailed on Sep. 13, 2012 (2 pages).

*Primary Examiner* — Faye Francis
(74) *Attorney, Agent, or Firm* — Wood, Herron & Evans, LLP

(57) ABSTRACT

Screw type liquid ring pump (1) with an integrated grinder or macerator (2), including a pump housing (3) with an inlet (5) and an outlet (7) and an, inside the housing, rotating helical screw rotor (4), which rotor at one end, the inlet end of the pump housing is provided with the grinder (11) and at the other end, the outlet end of the pump housing is communicating with a pressure chamber (6).
The screw rotor is provided on a shaft (18) connected (not shown) to a driving unit in the form of a motor, preferably an electric motor.
The grinder includes a rotary cutter (12) attached to the inlet end of the helical screw (4) shaft and a stationary cutter (13) attached to a grinder housing part (15), each cutter being provided with cutting tools or knives, whereby the rotary cutter (12) is freely rotating within the stationary cutter (13) when the pump is running. Each tool of the rotary cutter (12) has a cutting edge or knife (20) provided on a curved wing (21) such that the cutter is shaped like a pump impeller contributing to the pumping of the liquid through the macerator.

7 Claims, 5 Drawing Sheets

Figure 1:
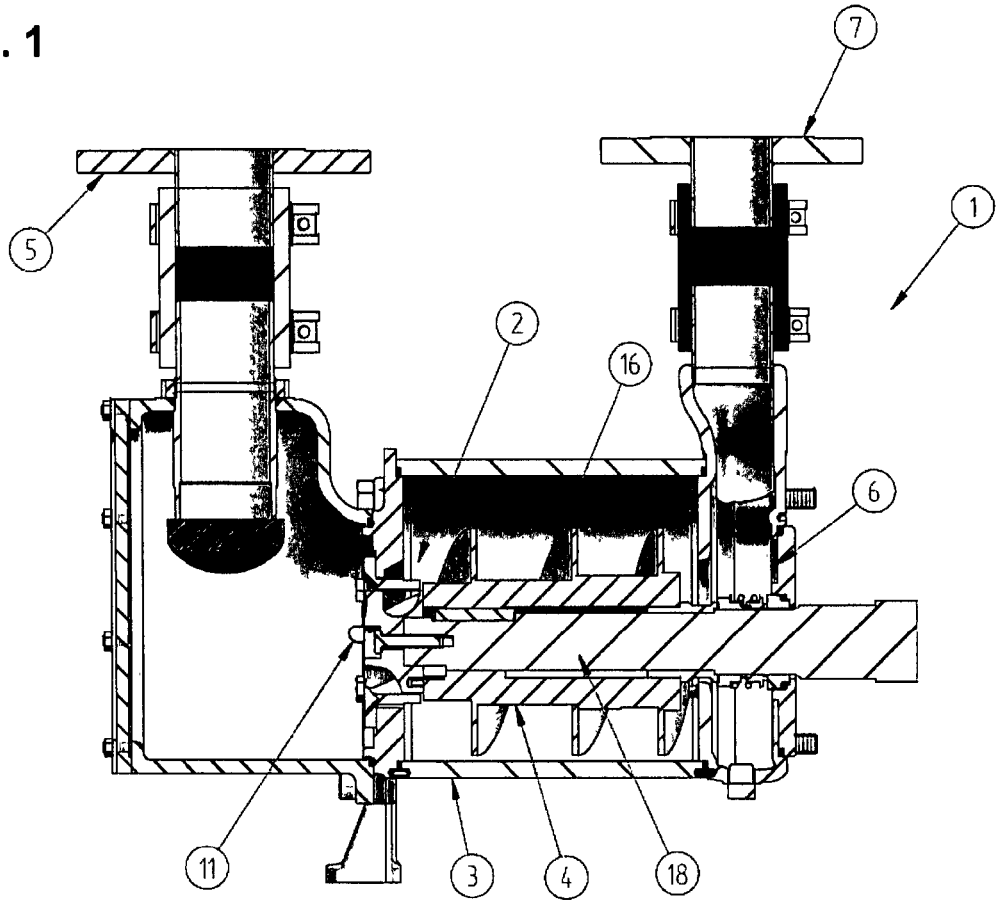

(51) Int. Cl.

| | |
|---|---|
| ***B02C 18/00*** | (2006.01) |
| ***B02C 19/22*** | (2006.01) |
| ***F01C 21/08*** | (2006.01) |
| ***F04C 7/00*** | (2006.01) |
| ***F04C 13/00*** | (2006.01) |
| ***F04C 18/16*** | (2006.01) |

(52) U.S. Cl.

CPC ..... *B02C 19/22* (2013.01); *F01C 21/08* (2013.01); *F04C 7/00* (2013.01); *F04C 13/001* (2013.01); *F04C 18/16* (2013.01); *F04C 2210/24* (2013.01)

(56) References Cited

U.S. PATENT DOCUMENTS

| | | | | |
|---|---|---|---|---|
| 3,643,877 | A | 2/1972 | Zimmer | |
| 4,141,510 | A * | 2/1979 | Smith | 241/46.02 |
| 4,637,785 | A | 1/1987 | Backstrom | |
| 5,016,825 | A * | 5/1991 | Carpenter | 241/46.06 |
| 5,302,082 | A * | 4/1994 | Gilbert | 415/121.1 |
| 8,113,802 | B2 | 2/2012 | Liang et al. | |
| 2004/0234370 | A1 * | 11/2004 | Simakaski et al. | 415/121.1 |

* cited by examiner

SCREW TYPE LIQUID RING PUMP WITH INTEGRATED MACERATOR

The present invention relates to a screw type liquid ring pump with an integrated grinder or macerator, including a pump housing with an inlet and an outlet and an, inside the housing, rotating helical screw rotor, which rotor at one end, the inlet end of the pump housing is provided with the grinder an at the other end, the outlet end of the pump housing is connected to a shaft which may be commonly provided for the rotor as well as a driving unit in the form of a motor, preferably an electric motor.

Liquid ring pumps with a grinder of the above kind are commonly known where the pump and the driving unit, usually an electric motor, are built together forming one unit. With such solution the production is simplified and the costs are reduced, mainly due to the fact that fewer constructional parts are required. These types of pumps are now the most used pumps in the market for the generation of vacuum and simultaneously grinding of the sewage in vacuum sewage systems.

In the applicants own European patent No. 0 454 794 an example is shown of a conventional liquid ring type helical screw pump of the above-mentioned type driven by an electrical motor and being provided with an integrated macerator. The macerator includes a stationary part attached to the inlet end of the pump housing and a rotating part connected to the inlet end of the rotor shaft. Each of the stationary and rotating parts are provided with interacting cutting knives which are designed to cut larger pieces of material such as paper, fabric material or excrements to small pieces before entering the rotor and rotor housing of the pump.

This known type of macerator is very effective as regards macerating ability, but represents a hindrance for the flow of the sewage through the pump and thereby reduces the pumping efficiency of the pump.

With the present invention is provided an improved macerator solution where the macerating ability and efficiency is maintained, but where the efficiency of the pump is vastly improved.

The invention is characterized by the features as defined in the attached independent claim 1.

Independent claims 2-4 define preferred embodiments of the invention.

Figure 2:
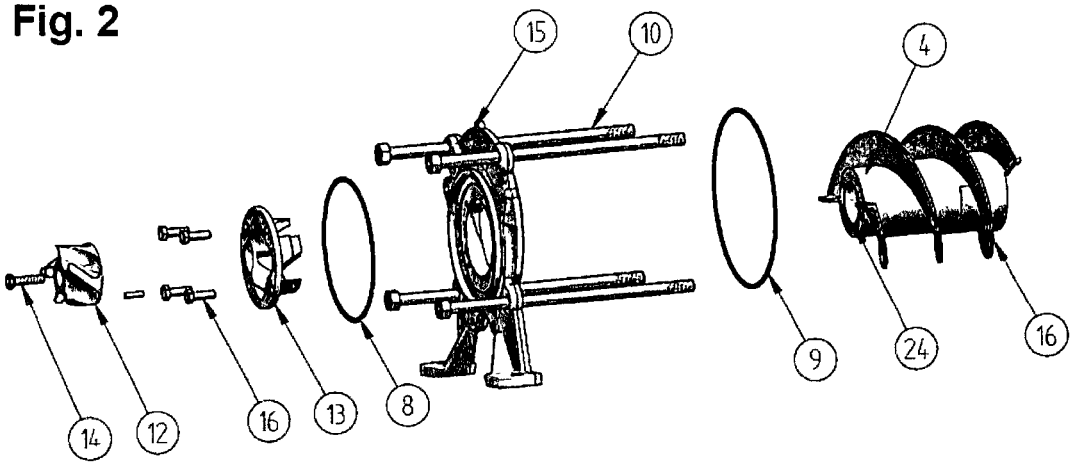
Figure 3:
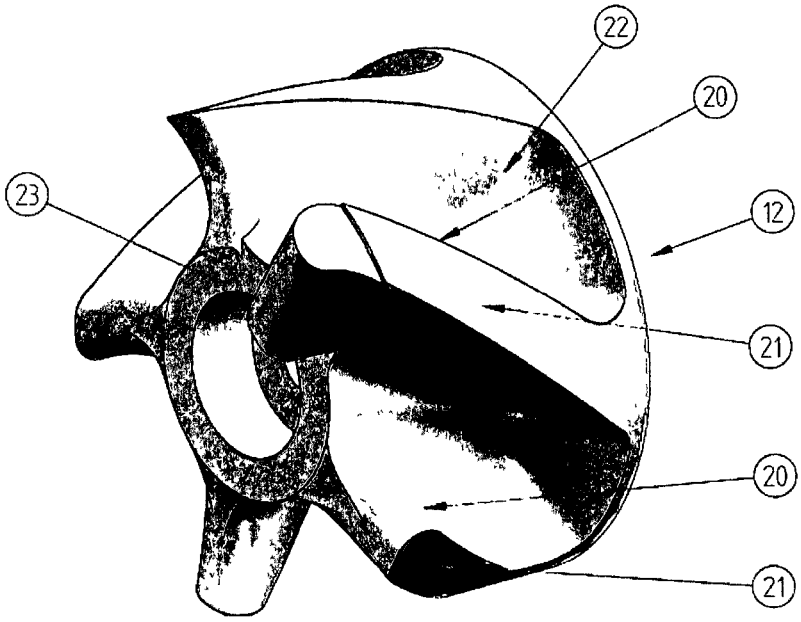
Figure 4:
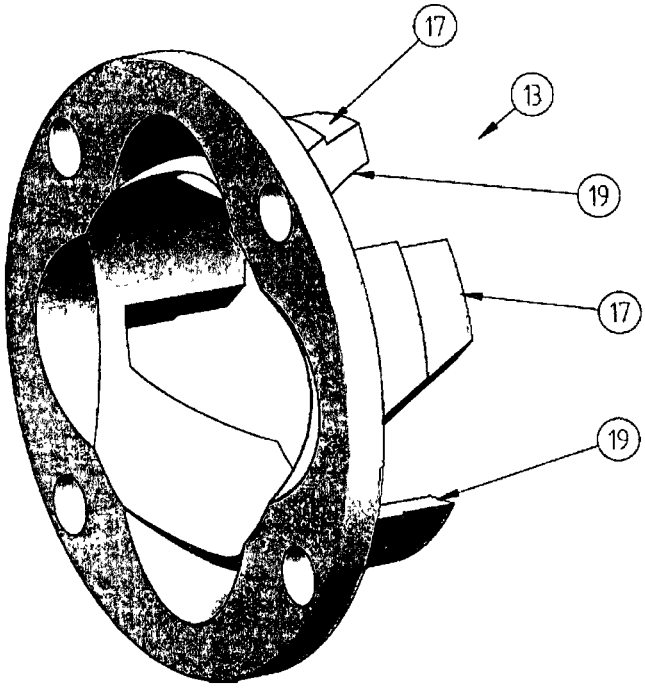
Figure 5:
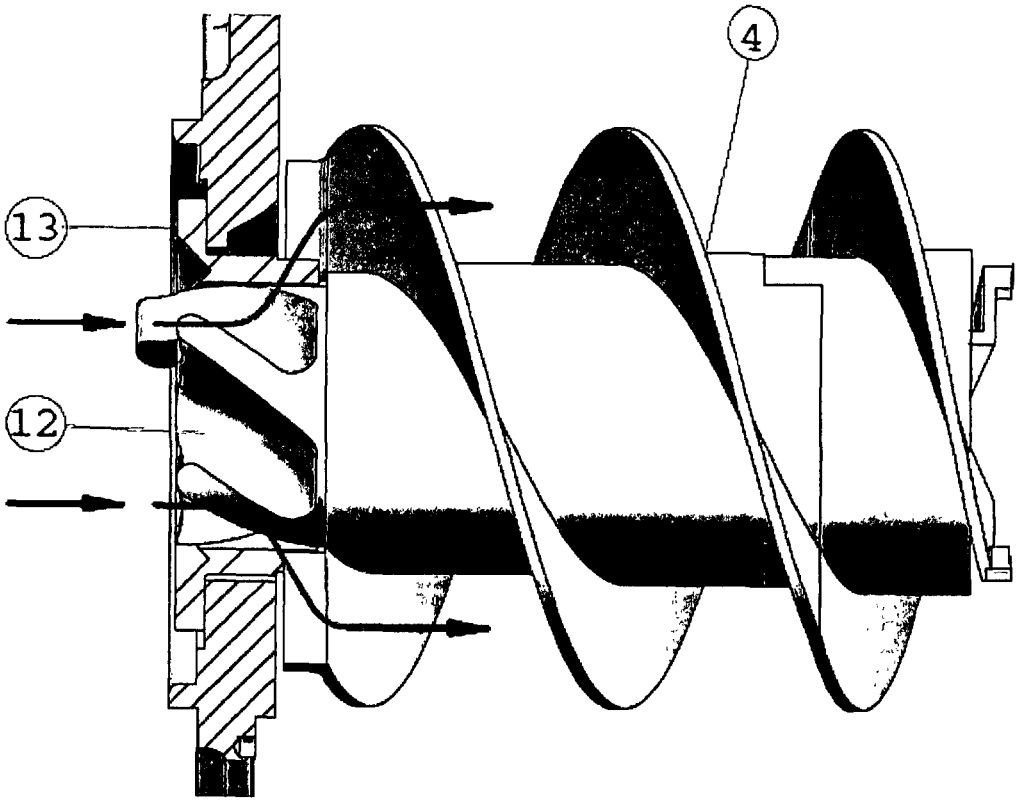
Figure 6:
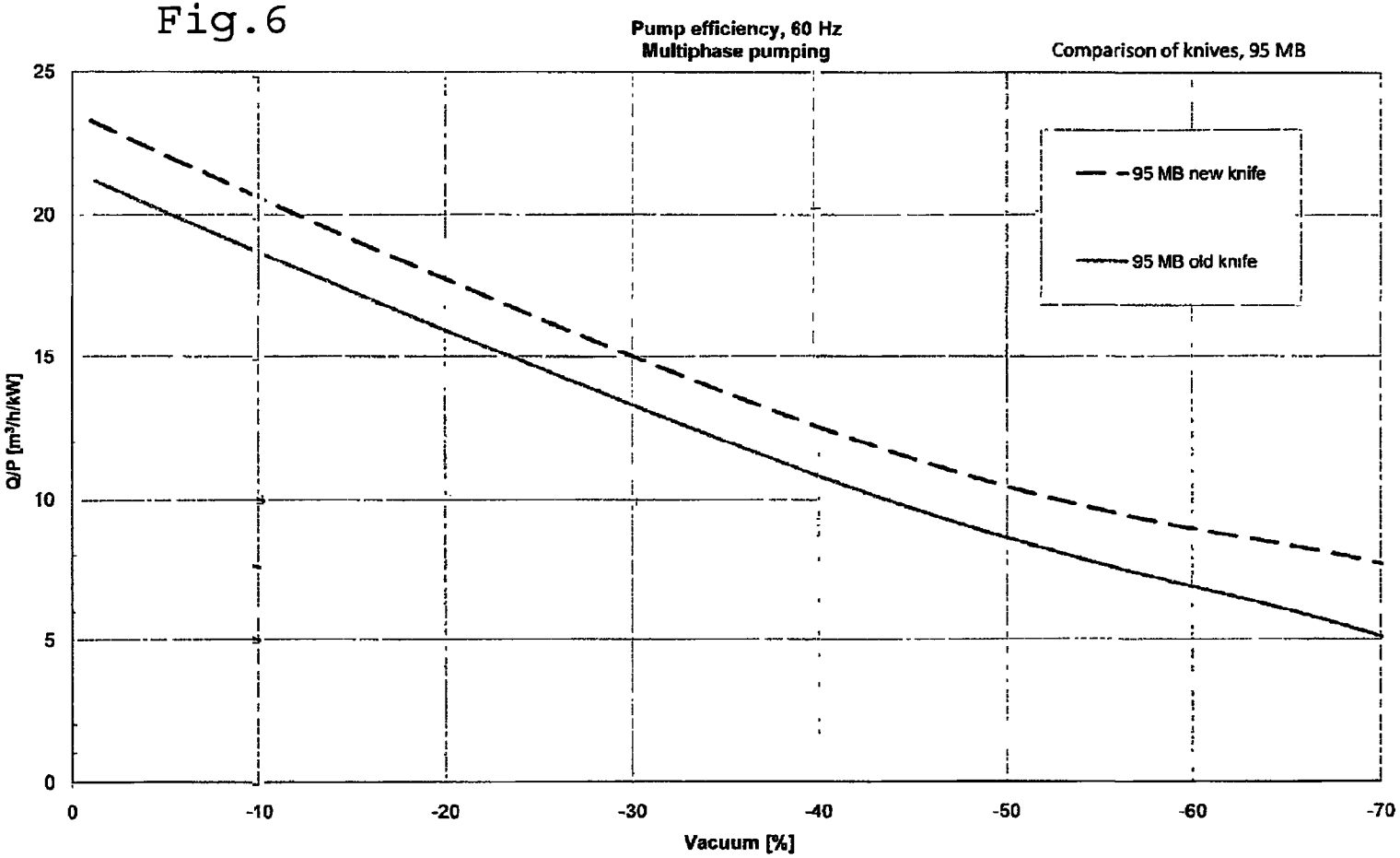
Figure 7:
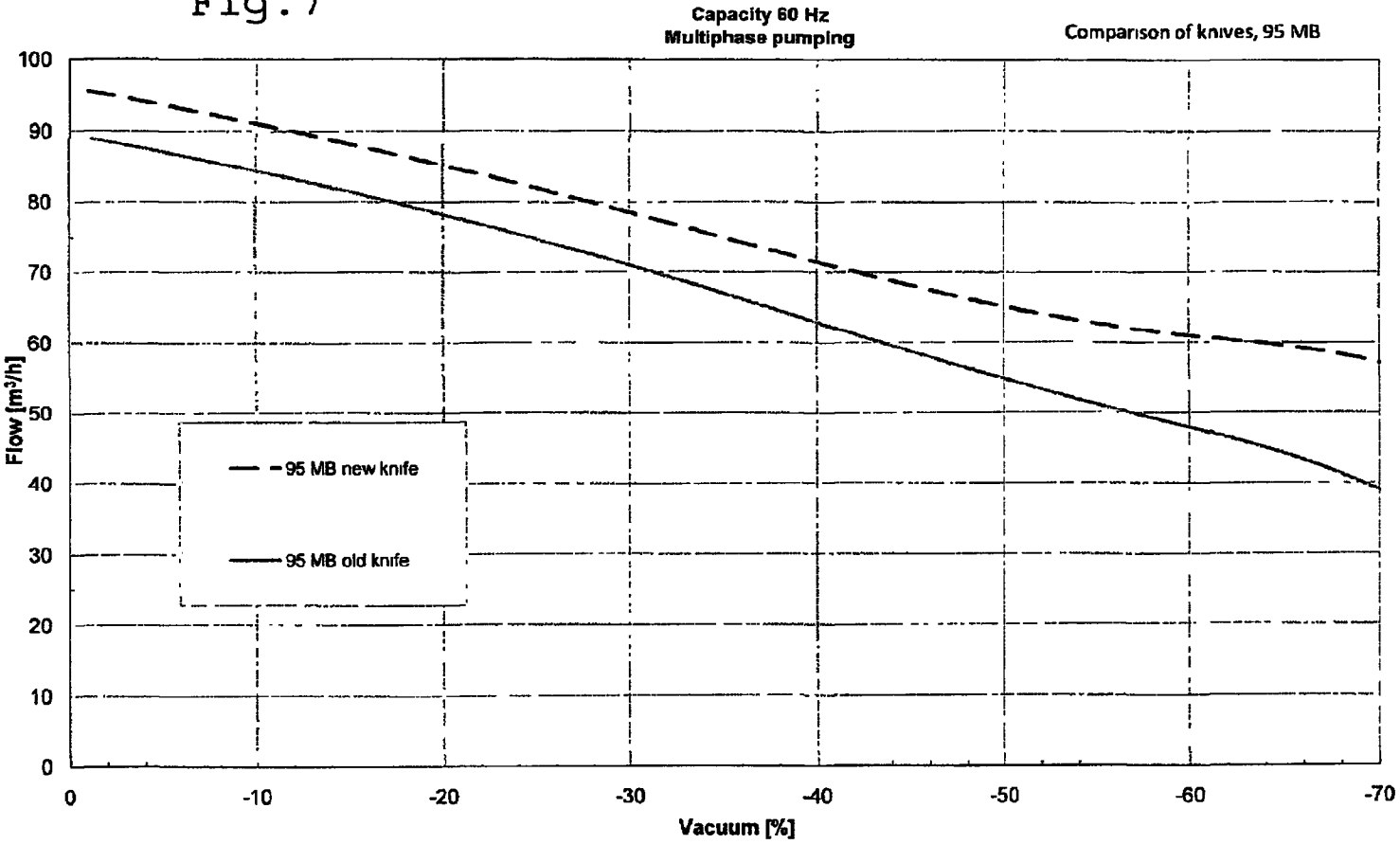

The invention will be further described in the following with reference to the drawings in which:

FIG. 1 shows a cross sectional view of a screw type liquid ring pump with integrated macerator according to the invention, FIG. 2 shows an expanded view of part of the pump shown in FIG. 1 including the screw rotor, end lid and stationary and rotary part of the macerator, FIG. 3 shows in larger scale the rotary cutter of the macerator, and FIG. 4 shows the stationary part of the macerator as shown in FIGS. 1 and 2, FIG. 5 shows the combined rotary cutter and helical screw rotor design with an indication of the continued flow pattern of such design, FIG. 6 is diagram showing the pump efficiency of a pump with the old type of rotary cutter and with the rotary cutter according to the present invention, FIG. 7 is a diagram showing the capacity of a pump with the old type of rotary cutter and with the rotary cutter according to the present invention.

FIG. 1 shows as mentioned above a liquid ring pump solution 1 (motor not shown) according to the present invention.

It includes a pump housing 2 and a helical screw rotor 4. The pump unit as such further includes an inlet part 3 with an inlet (inlet connection) 5. The screw rotor 4 with helically provided wings 16 is provided on a shaft 18 which may be an individual component or common for the motor and the pump. The rotor housing 2 is further connected to an outlet part or pressure chamber part 6 with an outlet (connection part) 7.

The main parts of the pump unit 1, i.e. the inlet part 3, the rotor housing 2 and the outlet part 6 are provided with intermediate sealing elements 8, 9 (see FIG. 2) and are held together in a tight connection by means of suitable screws 10.

As seen in FIGS. 1 and 2 the pump 1 further comprises a grinder 11 including a rotary cutter 12 attached to the outer end of the helical screw 4 shaft by means of a threaded screw 14 and a stationary part 13 attached to a grinder housing plate 15 by means of other suitable threaded screws 16.

The rotary cutter 12 is freely rotating within the stationary cutter 13 and when the pump is running, liquid including any larger particles such as textiles etc. passes by the cutters, whereby the particles are ground (by the cutters) to fine pieces avoiding clogging and eventually stoppage of the pump.

FIGS. 3 and 4 respectively shows in larger scale the rotary cutter 12 and stationary cutter 13. The stationary cutter 13 is provided with inwardly (in relation to the helical screw) protruding fingers 17 with cutting edges or knifes with positive cutting angle edge 19. On the other hand, the inventive feature of the rotating cutter 12 is the design of the cutting tools where each tool has cutting edges or knifes 20 provided on respective curved wings 21, which wings are shaped like the wings on a pump impeller. Each wing 21, as shown in FIG. 4, stretches from a front part of the cutter (inlet end relative to the pump) and ends in a flange or circular rear part 22 complimentary to a front part 24 (see FIG. 2) of the helical screw 4 on to which it is attached. Preferably the helical wings 21 of the rotary cutter 13 corresponds to and have the same direction as the wings 16 of the helical screw rotor 4. On the other hand the direction of grooves between the fingers 17 of stationary cutter 13 has the opposite direction.

On the front part of one of the wings 21 is in addition provided a knob or protrusion 23 stretching forward and beyond the wing cutter tools 21. The purpose of the protrusion 23 is to repel any compact pieces of metal or the like and thereby protect the grinder from being damaged.

Thus, with the above described novel design the rotary cutter 12 according to the present invention is not only shaped for grinding soft material but is as well designed to contribute to the pumping of the liquid through the macerator and thereby making the pump more efficient and effective.

Tests.

Tests where performed with a Jets' 95 MB pump comparing efficiency, capacity and grinding (cutting) ability for a pump with the old type of rotary cutter knives with the same pump but with the new type of rotary cutter knives according to the present invention.

The two test pumps with the old and new macerator respectively were tested under the same conditions, i. e. with the same gas/liquid ratio and same operating conditions. Under each of the tests, a "particle" in the form of floor washing cloth or textile mop, 60 cm long was sucked into the pump and used as material for the grinding tests. The results of the grinding of the textile mop were investigated "manually", comparing by measuring the size of ground particles for each test, by visually comparing the outer appearance of the particles from each test and by inspection, by inspection of the interior of the pump an by measuring the time it took to macerate textile mop completely.

Further, measurements were done to compare the capacity and efficiency of the pumps for the two tests. FIG. 5 is a diagram showing the efficiency, Q/P, i. e. the fluid volume/effect vs. the degree (percentage) of vacuum. FIG. 6 shows the capacity Q, i.e. the fluid volume vs. the degree of vacuum for each of the pumps.

Results.

Visual inspection showed minor or no difference between the ground particles of the pump with the old cutter and old knives compared to the new cutter with its knives as the particle size as well as the outer appearance was basically the same. Demounting and visual inspection of the interior of each pump showed as well that there was no material particles left in the pumps, they were both completely empty. Further, the time it took to grind the textile mop for each of the pumps was approximately 90 seconds. Therefore the conclusion based on the manual inspection is that the grinding properties are the same for the new macerator as for the old macerator.

As to efficiency and capacity, however, the new macerator shows vast improvements. Thus, FIG. 5 shows that the increase in Q/P relationship (fluid volume and effect relationship) vs. degree of vacuum varies between 10% (at a vacuum of 10%) and 25% (at 60% vacuum). Further, as is shown in FIG. 6 the improvement of capacity, i.e. the pumped fluid volume vs. degree of vacuum varies between 8% (at 10% vacuum) and 15% (at 60% vacuum).

It should be noted, even though the example shown in the drawings and described above include wings 21 with a particular curvature, length and visual design, the shape of the wings may, within the scope of the claims, vary depending among on the size of the pump and the angular velocity (RPM) for which the pump is designed. Thus, the wings 21 of the rotary cutter 12 may have a different length as well as curvature from what is shown in the drawings. Further, the wings 21 of the cutter may correspond with the wings of the helical pump screw 4 thereby forming a continued screw design as indicated in FIG. 5 where arrows indicate the continued flow pattern of the combined cutter and helical screw rotor through the stationary and rotary cutter 13 resp. 12 an further along the pump scre 4.

The invention claimed is:

1. A screw-type liquid ring pump comprising:

a pump housing having an inlet and an outlet;

a helical screw rotor inside the pump housing and provided on a shaft extending between the pump housing inlet and outlet, the shaft adapted to be driven;

a grinder associated with the inlet of the pump housing, the outlet of the pump housing communicating with a pressure chamber, the grinder including a stationary cutter attached to the pump housing inlet and a rotary cutter attached to the shaft of the helical screw rotor, the rotary cutter extending into and being freely rotatable within the stationary cutter when the shaft is driven, the stationary cutter including a plurality of cutting edges or knives, the rotary cutter including a plurality of curved wings each with a cutting edge or knife such that the rotary cutter defines a pump impeller shape whereby to contribute to pumping of liquid through the grinder.

2. Screw pump according to claim 1, the length and curvature of each wing of the rotary cutter varying depending on size, capacity and angular velocity of the screw pump.

3. Screw pump according to claim 2, the stationary cutter including inwardly, in relation to the helical screw rotor, protruding fingers, the plurality of cutting edges or knives of the stationary cutter being on respective ones of the fingers so as to define positive cutting angle edges thereto.

4. Screw pump according to claim 3, the helical screw rotor having rotor wings extending in a direction, the helical wings of the rotary cutter corresponding to and having the same direction as the rotor wings such that grooves defined between the fingers of the stationary cutter have a direction opposite to the direction of the helical wings.

5. Screw pump according to claim 1, the stationary cutter including inwardly, in relation to the helical screw rotor, protruding fingers, the plurality of cutting edges or knives of the stationary cutter being on respective ones of the fingers so as to define positive cutting angle edges thereto.

6. Screw pump according to claim 5, the helical screw rotor having rotor wings extending in a direction, the helical wings of the rotary cutter corresponding to and having the same direction as the rotor wings such that grooves defined between the fingers of the stationary cutter have a direction opposite to the direction of the helical wings.

7. Screw pump according to claim 1, the helical screw rotor having rotor wings extending in a direction, the helical wings of the rotary cutter corresponding to and having the same direction as the rotor wings such that grooves defined between the fingers of the stationary cutter have a direction opposite to the direction of the helical wings.

* * * * *